United States Patent [19]

McLean et al.

[11] Patent Number: 4,768,335

[45] Date of Patent: Sep. 6, 1988

[54] WICK LUBRICATED SPINNING AND TWISTING RING CONSTRUCTION

[75] Inventors: James N. McLean; Bruce A. McLean, both of Tonawanda, N.Y.

[73] Assignee: Herr Manufacturing Company, Inc., Tonawanda, N.Y.

[21] Appl. No.: 45,322

[22] Filed: May 4, 1987

[51] Int. Cl.[4] ..... D01H 7/62; D01H 7/64

[52] U.S. Cl. ..... 57/120; 57/122

[58] Field of Search ..... 57/119–124; 184/7.1

[56] References Cited

U.S. PATENT DOCUMENTS

| | | | |
|---|---|---|---|
| 2,102,861 | 12/1937 | Stuart | 57/120 |
| 2,282,468 | 5/1942 | Fillinger | 57/120 |
| 2,871,651 | 2/1959 | Fillinger | 57/120 |
| 2,936,568 | 5/1960 | Wayson et al. | 57/120 |
| 3,008,286 | 11/1961 | Wayson | 57/120 |
| 3,045,417 | 7/1962 | Wayson et al. | 57/120 |
| 3,321,900 | 5/1967 | Wayson | 57/122 X |
| 3,831,367 | 8/1974 | Atwood et al. | 57/120 |
| 3,872,662 | 3/1975 | Atwood et al. | 57/120 |
| 4,098,067 | 7/1978 | McLean | 57/120 |
| 4,382,357 | 5/1983 | McLean | 57/120 |

*Primary Examiner*—John Petrakes
*Attorney, Agent, or Firm*—Joseph P. Gastel

[57] ABSTRACT

A spinning and twisting ring and holder combination including a spinning and twisting ring having an inner ring surface, an outer ring surface, and a central ring portion therebetween, an annular lubricant conduit in the central ring portion, an annular groove in the outer ring surface, a holder having an inner holder surface and an outer holder surface and a holder block extending outwardly from the outer holder surface, the inner holder surface being mounted in fluid-tight relationship with the outer ring surface to cause the annular groove to be fluid-tight, a plurality of radial bores extending between the annular groove and the inner ring surface and in communication with the annular conduit, a well in the holder block, a first wick extending through conduits in the holder block and the well and having a portion located in the outer ring groove, and second wicks having portions located in engagement with the first wick in the annular groove and having second portions extending through the radial bores and the annular conduit in the spinning and twisting ring.

16 Claims, 3 Drawing Sheets

WICK LUBRICATED SPINNING AND TWISTING RING CONSTRUCTION

BACKGROUND OF THE INVENTION

The present invention relates to an improved wick lubricated spinning and twisting ring construction.

By way of background, spinning and twisting rings require precise amounts of lubrication throughout their internal surface for proper operation. If the distribution of the lubricant is not uniform, the traveler which rides on the spinning ring may tend to be impeded in its movement when it rides on portions which are not properly lubricated. The non-uniform lubrication is often experienced when the spinning and twisting rings are not perfectly level. This situation occurs frequently because the rings are mounted on rails which in turn are mounted on a frame of a machine which may be as much as 60 feet long. If the frame is not perfectly level, the rails will not be perfectly level and the spinning and twisting rings mounted thereon may be tilted from side-to-side or from front to back.

In addition to the foregoing, a wick-lubricated spinning ring such as shown in U.S. Pat. No. 4,098,067 is known. In this ring, a wick is threaded through the annular conduit within the ring which carries lubricant to the inner surface of the ring. However, threading a wick through the annular conduit was a difficult and time-consuming task. Furthermore, in this prior construction there were no radial wicks for conveying lubricant to the inner surface of the ring.

SUMMARY OF THE INVENTION

It is accordingly one object of the present invention to provide a wick-lubricated spinning and twisting ring construction in which proper lubrication is provided to all portions thereof even though it may be tilted away from a perfectly horizontal attitude.

Another object of the present invention is to provide a wick-lubricated spinning and twisting ring construction in which the wick is installed on the ring in an extremely simple and efficient manner.

A further object of the present invention is to provide an improved holder and spinning and twisting ring combination wherein a wick-carrying groove in the outside surface of the spinning and twisting ring is confined in fluid-tight relationship by the associated holder.

Yet another object of the present invention is to provide an improved holder for a spinning and twisting ring having a well with felt located therein for enhancing flow of lubricant to a wick associated with the holder and the spinning and twisting ring mounted thereon. Other objects and attendant advantages of the present invention will readily be perceived hereafter.

The present invention relates to a spinning and twisting ring construction comprising an annular ring having an inner surface and an outer surface and a central portion therebetween, an annular lubricant conduit within said central portion of said annular ring, an annular groove in said outer surface, first wick means in said annular groove for conveying lubricant, a seam extending between said inner surface and said annular conduit for conducting lubricant from said lubricant conduit to said inner surface, radial bore means extending through said central portion from said annular groove to said annular conduit, and second wick means in said radial bore means having a first portion in contact with said first wick means to receive lubricant therefrom and a second portion in communication with said annular conduit to conduct lubricant thereto from said first wick means.

The present invention also relates to a holder and spinning and twisting ring combination comprising a spinning and twisting ring having an inner ring surface and an outer ring surface and a central ring portion therebetween, a lubricant conduit in said central ring portion, an annular groove in said outer ring surface, a holder having an inner holder surface mounted on said outer ring surface with a portion of said inner holder surface blocking off said annular groove, cooperating means on said inner holder surface and said outer ring surface to effect a substantially fluid-tight relationship therebetween to prevent leakage of lubricant from said groove, and bore means in said central ring portion for effecting communication between said annular groove and said annular conduit.

The present invention also relates to a holder for a spinning and twisting ring comprising a substantially annular portion having an inner surface and an outer surface, a holder block extending outwardly from said outer surface, a well in said holder block, a first conduit in said holder block extending between said inner surface and said well, a second conduit in said holder block extending away from said well toward an external area, felt means in said well, and wick means including a first wick portion in said first conduit and a second wick portion in said second conduit and a third wick portion in said well in contact with said felt means.

The various aspects of the present invention will be more fully understood when the following portions of the specification are read in conjunction with the accompanying drawings wherein:

DESCRIPTION OF THE PREFERRED EMBODIMENTS

Figure 1:
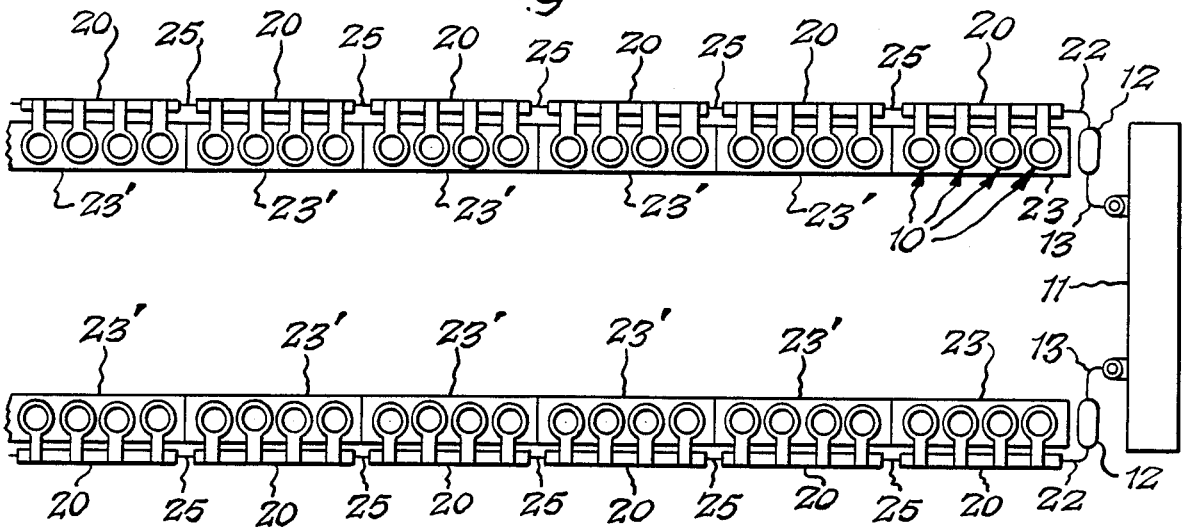
FIG. 1 is a fragmentary plan view of a spinning and twisting ring installation including the improved construction mounted on various rails of a frame.
Figure 2:
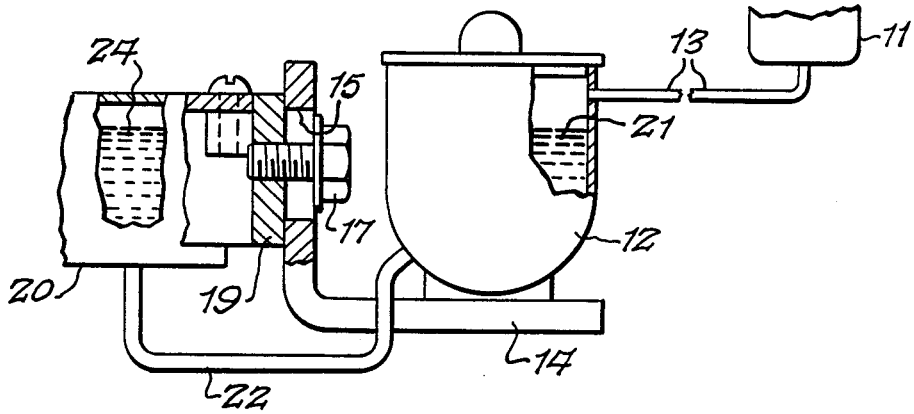
FIG. 2 is an enlarged fragmentary side elevational view of the lubricant level control chamber or carburetor and an associated lubricant manifold.
Figure 3:
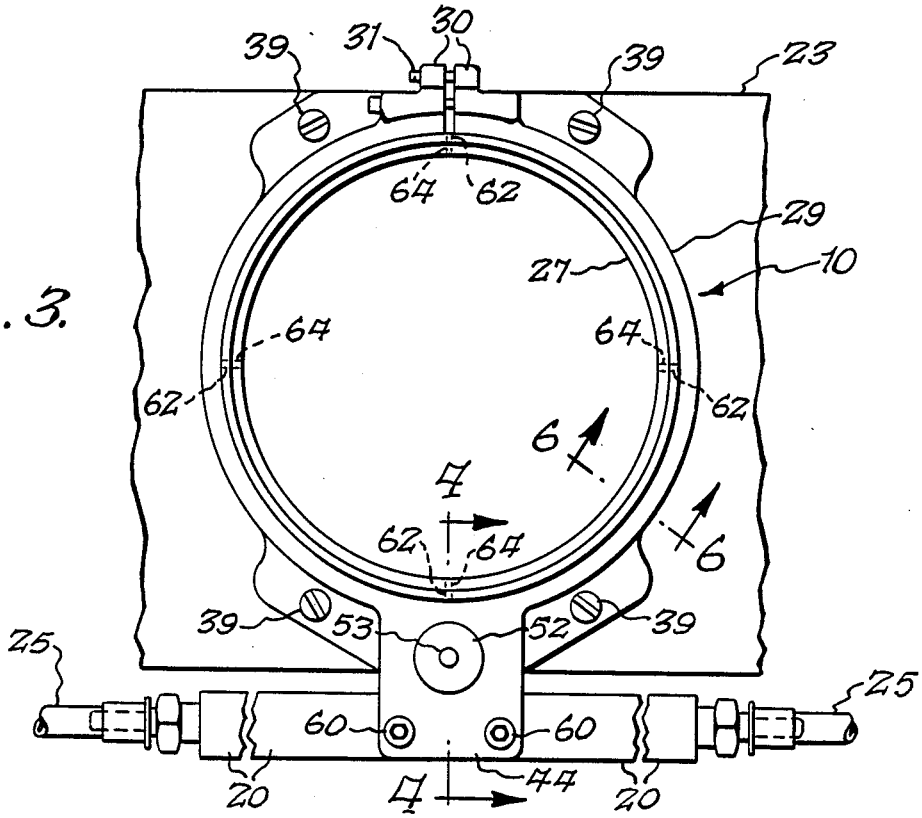
FIG. 3 is a fragmentary plan view showing the improved spinning and twisting ring mounted on a holder which is mounted on a rail and also showing the lubricant manifold in association with the holder.

A lubrication system which may contain the improved spinning and twisting ring structures 10 of the present invention includes a gravity lubricant feed arrangement wherein a lubricant reservoir 11 feeds an automatic lubricant level control chamber or carburetor 12 through conduit 13. Carburetor 12 is mounted on a bracket 14 which may have its elevation adjusted by moving it vertically so that slot 15 therein may occupy various positions relative to screw 17 which attaches bracket 14 to the end 19 of lubricant manifold 20. The lubricant 21 in carburetor 12 is fed to lubricant manifold 20 by conduit 22. There are a plurality of manifolds 20, and each manifold 20 is associated with a rail 23 which is mounted on the frame (not shown) of the spinning or twisting machine. The lubricant 21 in carburetor 12 is maintained at a desired level by a suitable float device (not shown) and this will be the level of the lubricant 24 in lubricant manifold 20. A plurality of additional rails 23' are mounted on the frame in alignment with each rail 23 and they are identical to each other and to rail 23. Each rail has associated therewith a lubricant manifold 20 and adjacent manifolds are coupled to each other by conduits 25. Thus the lubricant level in each of the manifolds 20 will be at the same level as the lubricant in carburetor 12.

The frames of the spinning and twisting machines may be up to 60 feet long and mount a plurality of rails 23 and 23' in end-to-end relationship. It will be appreciated that the rails may not be perfectly level and thus the spinning and twisting ring assemblies 10, each of which includes a ring 27 and a holder 29, may not be perfectly level. Accordingly, lubricant which was supplied to prior art constructions, tended to gravitate to the lowest points of the spinning and twisting rings 27 and thus adequate lubrication was not provided to the higher portions. This prevented proper operation of the rings.

Figure 4:
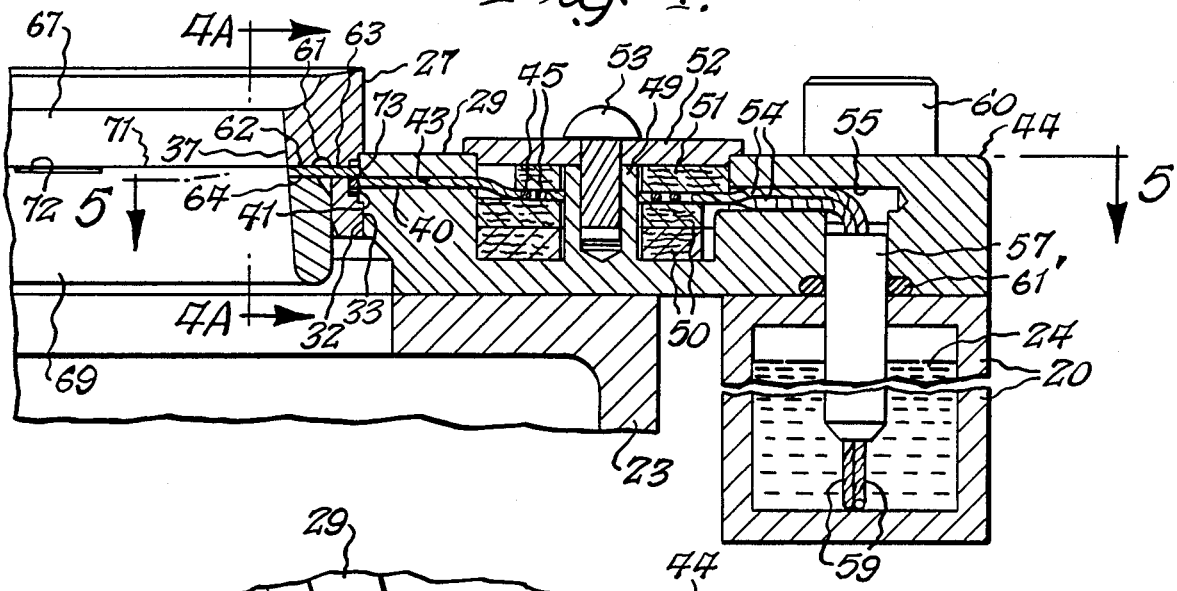
FIG. 4 is a fragmentary cross sectional view taken substantially along line 4—4 of FIG. 3 and showing a well in the holder block and also showing the lubricant manifold mounted on the lubricant block and also showing the various wicks.
Figure 4A:
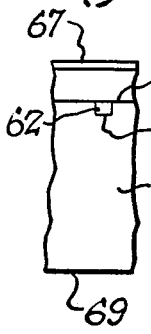
FIG. 4A is a fragmentary elevational view taken in the direction of the arrows 4A—4A of FIG. 4.
Figure 5:
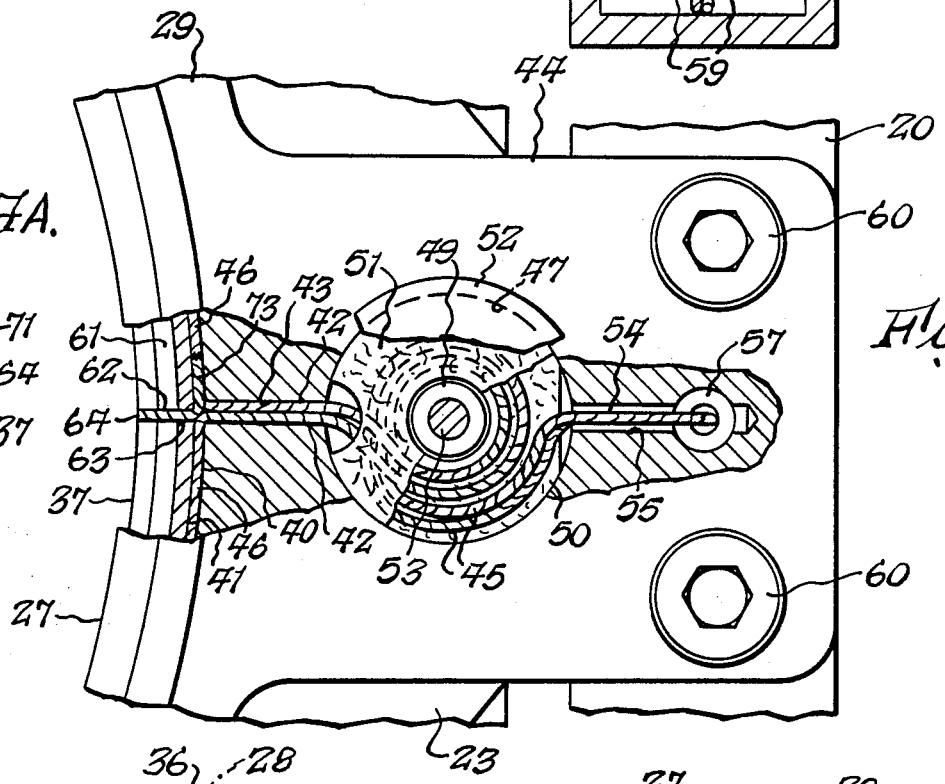
FIG. 5 is a fragmentary plan view taken substantially along line 5—5 of FIG. 4.
Figure 6:
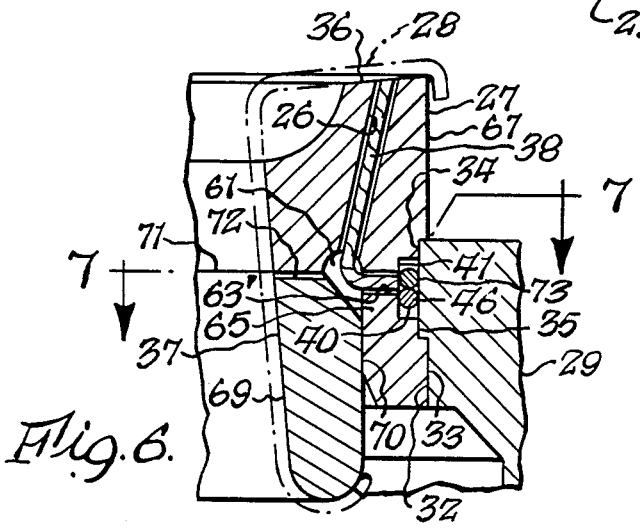
FIG. 6 is a fragmentary cross sectional view taken substantially along line 6—6 of FIG. 3.
Figure 7:
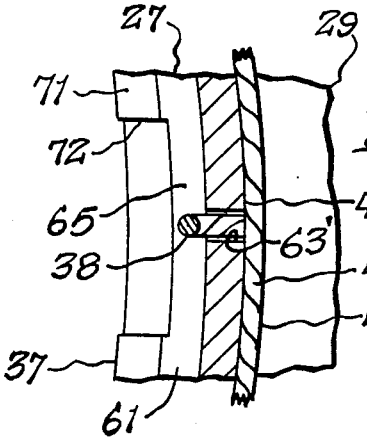
FIG. 7 is a fragmentary cross sectional view taken substantially along line 7—7 of FIG. 6 and showing the slot structure which feeds lubricant to the inner surface of the ring.
Figure 8:
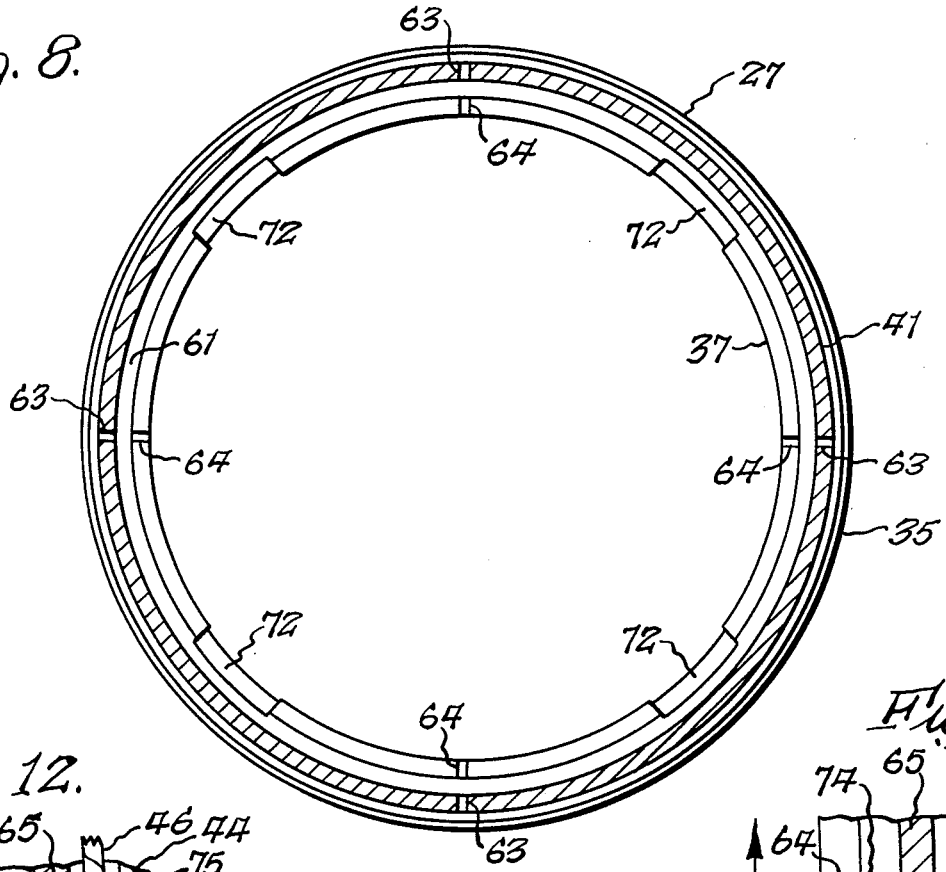
FIG. 8 is a cross sectional view taken substantially along line 7—7 of FIG. 6 but showing the structure of the ring without the holder and without the wicks associated therewith.

In accordance with the present invention, a lubrication system is provided for spinning and twisting rings 27 which insures adequate lubrication to all portions thereof, even though the rings may not be perfectly level so that traveler 28 operates properly. As noted briefly above, each ring 27 is mounted within holder 29, the ends 30 of which are drawn together by screw 31 to tighten the internal surface 32 of holder 29 about the outer surface 33 of ring 27 (FIGS. 4 and 6). Annular portion 34 of holder 29 fits into groove 35 of ring 27. Ring 27 also includes an inner surface 37 in addition to its outer surface 33. The holder 29 is secured to rail 23 by a plurality of screws 39.

The improved lubrication structure associated with spinning and twisting ring constructions 10 includes an elongated continuous wick 40 (FIGS. 4, 5, 6 and 9) having a portion 46 which is received in groove 41 of ring 27. The annular side 34 of holder 29, which fits into ring groove 35, forms a tight seal therewith so that the groove 41 is substantially fluid-tight to prevent any significant amount of lubricant leakage. The ends 42 of wick 40 are received in bore 43 of holder block 44 which comprises an integral portion of the holder 29. The wick 40 includes portions 45 which are received in well 47 in holder block 44 and are wound around post 49 therein. A plurality of felt washers 50 are located below wick end portions 45 and a felt washer 51 is located above wick portions 45. A circular cap 52 is secured in fluid-tight relationship to the top of holder block 44 by screw 53. The end portions 54 of wick 40 are received in bore 55 of holder block 44 and they pass through sleeve 57 mounted therein and have terminal portions 59 which are immersed in lubricant 24 within lubricant manifold 20. It can thus be seen that lubricant will flow through wick portions 59, 54, 45, 42 and 46. Furthermore, felt washers 50 and 51 become saturated and thus provide an additional reservoir of lubricant for the wick. Each lubricant manifold 20 is secured to holder block 44 by a pair of screws 60 and an O-ring 61' is placed in encircling relationship to tube 57 (FIG. 4) to seal the joint between holder block 44 and the top of lubricant manifold 20. Screws 60 extend through oversized bores in holder block 44 and are received in tapped holes in the top wall of manifold 20. A precise form of connection may be the same as shown in FIG. 6 of U.S. Pat. No. 4,382,357, which is incorporated herein by reference.

The lubricant which is conveyed by the above-described wick structure from each manifold 20 to wick portion 46 is conveyed to inner annular conduit 61 by a plurality of radially extending wick portions 62 which pass through pairs of aligned bores 63–64. Bores 63 are located in the central portion 65 of ring 27, this central portion being located in upper ring portion 67 (FIG. 6) into which lower ring portion 69 is inserted with a friction fit to provide a seam 70 therebetween, as is well known in the art. In addition, there is a seam 71 (FIG. 4) between lower ring portion 69 and upper ring portion 67 through which lubricant seeps. In addition, a plurality of circumferentially spaced slots 72 are formed in the top surface of lower ring portion 69 for providing channels for flow of lubricant, as is well known. The bores 64, which are aligned with bores 63, are formed only in the upper surface of lower ring portion 69. A central wick portion 73 (FIG. 9) is located between each pair of radial wicks 62, and each wick portion 73 lies in ring groove 41 in contact with the wick 40 and thus receives lubricant therefrom. This lubricant passes through radial wick portions 62 in bores 63–64 and thus conveys lubricant to annular conduit 61 within ring 27 and to the inner surface 37 of the ring where radial wick portions 62 terminate. Thus lubricant is passed to conduit 61 and to the inner surface of the ring at four areas which are spaced 90° apart to thereby provide lubricant to such four spaced portions regardless of how ring 27 is tilted away from a perfectly horizontal position.

Figure 12:
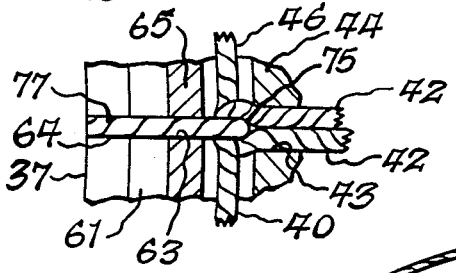
FIG. 12 is a fragmentary view showing only how the radial wick is connected to the wick in the annular groove at the location of the holder block.
Figure 10:
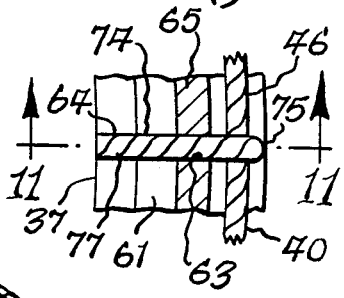
FIG. 10 is a fragmentary plan view similar to the broken-away portion of FIG. 5 and showing a portion of an alternate wick embodiment which extends through the radial holes in the ring.
Figure 9:
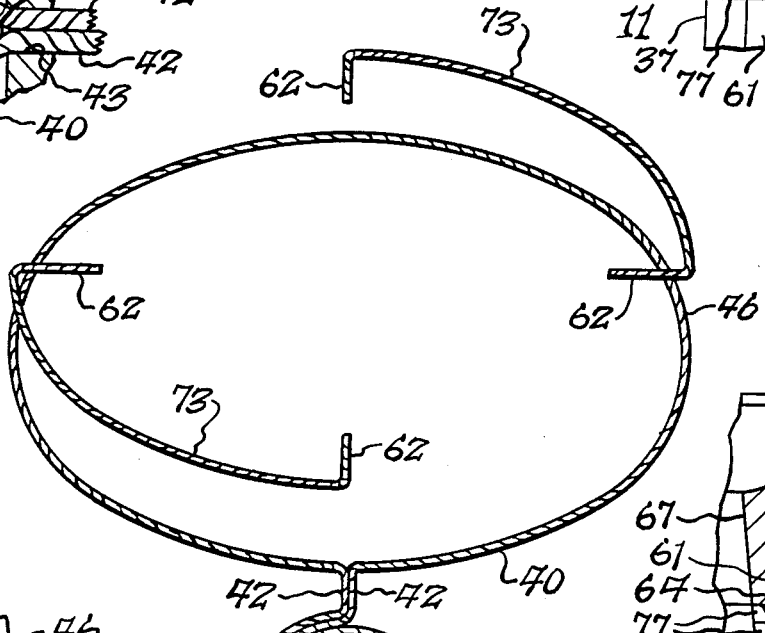
FIG. 9 is a fragmentary perspective view showing the wick structure which is associated with the ring.
Figure 11:
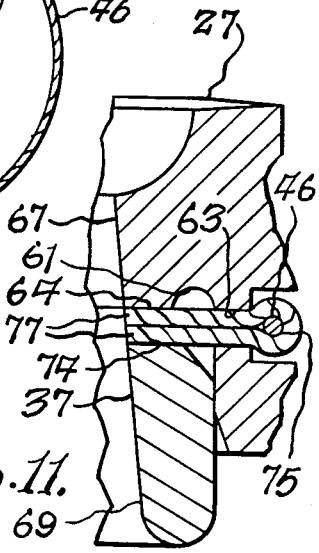
FIG. 11 is a cross sectional view taken substantially along line 11—11 of FIG. 10.

In FIGS. 10–12 an alternate construction is shown for conveying lubricant from circumferential wick portion 46 to annular conduit 61 and inner ring surface 37. There are four radially extending wicks 74, each of which includes a loop having a bend 75 which encircles wick portion 46 and which has two loop ends 77 which extend through bores 63 and 64, the wick ends terminating at inner surface 37. The relationship between loop bend 75 and wick portions 42, which enter bore 43 in holder block 44, is shown in FIG. 12.

Figure 13:
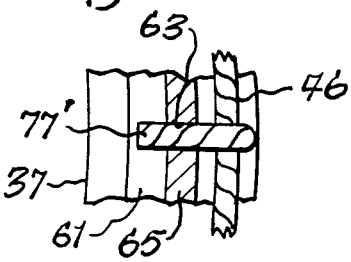
FIG. 13 is a fragmentary cross sectional view of an alternate embodiment wherein the radial wicks terminate in the annular conduit.

It will be appreciated that while all of the radial wick portions 62 and 77 have been shown as terminating at inner surface 37 of the ring, it will be appreciated that, if desired, the radial wick portions 62 and 77 may terminate within annular conduit 61 or within central ring portion 65. In the latter event, there would be no need to have radial bore portions 64 and thus the latter can be eliminated if desired. This alternate embodiment is shown in FIG. 13 wherein wick portion 77' is analogous to wick portion 77 and it terminates in annular conduit 61, and there is no bore 64 in alignment with bore 63. If desired, the wick portion 77' may terminate in radial bore 63. Also, it will be appreciated that radial wick portions which are analogous to radial wick portions 62 of FIG. 9 may also terminate either in the annular conduit 61 or in bore 63.

Suitable structure is provided for lubricating the upper face 36 (FIG. 6) of the ring. In this respect, a plurality of circumferentially spaced bores 63' (FIG. 6) are provided between annular groove 41 and annular conduit 61. A plurality of second circumferentially spaced bores 26 are also provided in upper ring portion 67, each of which is in the same vertical plane as an associated bore 63'. A wick 38 extends from groove 41 through associated bores 63' and 26 and conduit 61 and terminates at upper face 36. Preferably there are three sets of bores 26–63' spaced at 120° from each other. The circumferential location of bore sets 26–63 has been shown in FIG. 6 for convenience, but it will be appreciated that these sets can occupy any desired circumferential positions. If desired, the wicks 38 may be looped around wick 46 in the manner shown in FIGS. 10 and 11, or may be placed into contact therewith in any suitable manner, such as being wedged between wick portions 46 and 73 where possible. It will be appreciated that wicks 38 serve the dual function of supplying lubricant to both annular conduit 61 and upper face 36. Other known structures may be used to lubricate upper face 36.

While the present application has shown only a conical ring, it will be appreciated that the present invention is equally applicable to vertical rings, except that the latter does not require lubrication to the upper surface.

It thus can be seen that the improved wick construction of the present invention is manifestly capable of conveying lubricant to widely spaced portions of a spinning and twisting ring, and while preferred embodiments of the present invention have been disclosed, it will be appreciated that it is not limited thereto but may be otherwise embodied within the scope of the following claims.

What is claimed is:

1. A spinning and twisting ring construction comprising an annular ring having an inner surface and an outer surface and a central portion therebetween, an annular lubricant conduit within said central portion of said annular ring, an annular groove in said outer surface, first wick means in said annular groove for conveying lubricant, a seam extending between said inner surface and said annular conduit for conducting lubricant from said lubricant conduit to said inner surface, radial bore means extending through said central portion from said annular groove to said annular conduit, and second wick means in said radial bore means having a first portion in contact with said first wick means to receive lubricant therefrom and a second portion in communication with said annular conduit to conduct lubricant thereto from said first wick means.

2. A spinning and twisting ring construction as set forth in claim 1 wherein said radial bore means comprise a plurality of radial bores circumferentially spaced on said annular ring.

3. A spinning and twisting ring construction as set forth in claim 2 including a plurality of slots at said inner surface in communication with said seam, said slots being interspersed with said radial bores.

4. A spinning and twisting ring construction as set forth in claim 2 including a holder, and an inner holder surface on said holder in mating engagement with said outer surface of said annular ring to confine said first wick means in said annular groove.

5. A spinning and twisting ring construction as set forth in claim 4 including a holder block member extending outwardly from said holder, a well in said holder block member, felt means in said well for storing lubricant, and third wick means in communication with both said felt means and said first wick means to conduct lubricant from said well to said first wick means.

6. A spinning and twisting ring construction as set forth in claim 5 including a lubricant source mounted on said holder block member for containing lubricant, and fourth wick means in communication with said lubricant source and said felt means in said well to conduct lubricant from said lubricant source to said felt means.

7. A spinning and twisting ring construction as set forth in claim 6 wherein said third wick means and said fourth wick means are integral continuations of said first wick means.

8. A spinning and twisting ring construction as set forth in claim 6 wherein said felt means comprises a plurality of stacked annular felt washers, post means in said well on which said annular washers are mounted, and wherein portions of said third and fourth wick means within said well are located between said felt washers.

9. A spinning and twisting ring construction as set forth in claim 8 wherein said third wick means and said fourth wick means are integral continuations of said first wick means, and wherein the portions of said integral continuations within said well are wound about said post means.

10. A spinning and twisting ring construction as set forth in claim 2 wherein said second wick means comprise an elongated wick member having a central portion located in the portion of said annular groove between adjacent radial bores, said central portion of said elongated wick member being in contact with said first wick means, and said elongated wick member having end portions extending through said radial bores.

11. A spinning and twisting ring construction as set forth in claim 10 wherein a plurality of said elongated wick members are mounted on said annular ring.

12. A spinning and twisting ring construction as set forth in claim 2 wherein said second wick means comprise a loop of wick material having a bend portion and two loop portions extending away from said bend portion, said bend portion extending about said first wick means and said two loop portions extending into said annular conduit.

13. A spinning and twisting ring construction as set forth in any of claims 2–12 wherein said radial bores include a portion extending from said annular conduit to said inner surface, and wherein said second wick means terminate at said inner surface.

14. A spinning and twisting ring construction as set forth in claim 1 wherein said radial bore means extend from said annular groove to said inner surface, and wherein said second wick means terminate at said inner surface.

15. A holder for a spinning and twisting ring comprising a substantially annular portion having an inner surface and an outer surface, a holder block extending outwardly from said outer surface, a well in said holder block, a first conduit in said holder block extending between said inner surface and said well, a second conduit in said holder block extending away from said well toward a lubricant source, felt means in said well, and wick means including a first wick portion in said first conduit and a second wick portion in said second conduit and a third wick portion in said well in contact with said felt means.

16. A holder for a spinning and twisting ring as set forth in claim 15 including a post in said well, and wherein said third wick portion is wound about said post.

* * * * *